US005143443A

United States Patent [19]

Madsen

[11] Patent Number: 5,143,443

[45] Date of Patent: Sep. 1, 1992

[54] LIGHT PERMEABLE, COLOR ADDING, SELF-SECURING STRESSED COVERS FOR LARGE DISPLAY LIGHT-EMITTING DEVICES, AND METHODS

[75] Inventor: Brent D. Madsen, Providence, Utah

[73] Assignee: Integrated Systems Engineering, Inc., Logan, Utah

[21] Appl. No.: 575,929

[22] Filed: Aug. 31, 1990

[51] Int. Cl.[5] ..... F21V 17/04; H01K 1/32

[52] U.S. Cl. ..... 362/255; 362/249; 362/256; 362/812; 313/635; 524/921

[58] Field of Search ..... 362/242, 249, 252, 255, 362/256, 812; 313/489, 635; 524/908, 921; 528/901; 106/904

[56] References Cited

U.S. PATENT DOCUMENTS

| | | | |
|---|---|---|---|
| 1,050,967 | 1/1913 | McComb | 362/255 |
| 1,174,377 | 3/1916 | Appleton | 362/255 |
| 1,465,333 | 8/1923 | Ashley | 362/255 |
| 1,488,265 | 3/1924 | Matsuo | 362/255 |
| 1,671,472 | 5/1928 | Green | 362/252 |
| 2,354,367 | 7/1944 | Ford | 362/812 |
| 2,461,254 | 2/1949 | Bassett | 250/165 |
| 2,820,918 | 1/1958 | Aronstein | 313/108 |
| 2,830,002 | 4/1958 | Mohs | 154/110 |
| 3,283,136 | 11/1966 | Dinkler et al. | 362/812 |
| 3,602,759 | 8/1971 | Evans | 313/112 |
| 3,930,796 | 1/1976 | Haensel | 21/74 R |
| 4,048,537 | 9/1977 | Blaisdell | 313/489 |
| 4,591,959 | 5/1986 | Kenyon | 362/252 |
| 4,632,855 | 12/1986 | Conlon | 428/36 |
| 4,807,378 | 2/1989 | Bell | 362/812 |
| 4,830,893 | 5/1989 | Nakamura | 428/35.8 |
| 4,954,937 | 9/1990 | Kobayashi et al. | 362/255 |
| 5,040,098 | 8/1991 | Tanaka | 362/26 |

FOREIGN PATENT DOCUMENTS

| | | | |
|---|---|---|---|
| 0060046 | 2/1990 | Japan | 313/635 |
| 8803327 | 5/1988 | United Kingdom | 313/635 |

OTHER PUBLICATIONS

Pigment Handbook, vol. I, Peter A. Lewis.
Pigment Handbook, vol. II, Temple C. Patton.

*Primary Examiner*—Ira S. Lazarus
*Assistant Examiner*—Y. Quach
*Attorney, Agent, or Firm*—Lynn G. Foster

[57] ABSTRACT

A long useful life, light permeable cover of pigmented, injection-molded silicone rubber for elastic manual placement over and self-retention on a light source enclosure. The cover, due to memory, is self-biasing and self-retaining upon the light source enclosure against inadvertent removal and may be used in large multicolor, automatically programmable, electrically changeable, broad spectrum displays, such as scoreboards.

41 Claims, 1 Drawing Sheet

LIGHT PERMEABLE, COLOR ADDING, SELF-SECURING STRESSED COVERS FOR LARGE DISPLAY LIGHT-EMITTING DEVICES, AND METHODS

FIELD OF THE INVENTION

The present invention relates generally to covers, and related methods, for light-emitting devices and more particularly to self-securing, manually replaceable, light permeable, color adding, stressed enclosure covers for light sources used in large displays which provide a long and effective useful life in adverse environments and under hostile conditions, and to such light filtering covers which selectively filter discrete portion of the color spectrum of emitted light while transmitting other portions.

RELATED ART

Transparent and translucent covers for light-emitting devices is generally old. Light shields were proposed for use in protecting light-emitting devices from weathering and other environmental deterioration early in this century. See U.S. Pat. Nos. 1,050,967; 1,465,333 and 1,488,265. These covers also provided color filters for the devices so covered. Rapid deterioration of prior light source covers due to weathering, expansion and contraction of the lamps, fading, and wearing off have remained a problem. Also, such early devices also had relatively short lifetimes and other inherent limitations related to cost of manufacture and maintenance.

As an example, the light shield of U.S. Pat. No. 1,050,967 required a metal sleeve to anchor the shield to a lamp. The more flexible shades of U.S. Pat. Nos. 1,465,333 and 1,488,265 comprised inflatable covers and required short-term periodic maintenance to replace lost size maintaining air pressure.

A number of filters for fluorescent tubes are disclosed in the related art. For example, a loose fitting light filter for filtering ultra-violet light and reducing glare of fluorescent tubes is disclosed in U.S. Pat. No. 2,820,918 wherein therapeutic considerations related to the use of fluorescent tubes is of paramount concern. Another protective shield for an ultraviolet-emitting fluorescent lamp, disclosed in U.S. Pat. No. 4,048,537, also comprises tubular construction and is primarily concerned with affecting light transmission along the length of the tube.

A thermal process, involving the use of plastic shrinking tubing as covers for fluorescent tubes is disclosed in U.S. Pat. No. 3,602,759. Objectives of applying plastic shrink material to the exterior length of fluorescent tubes, as described therein, comprise an enclosure to improve the ruggedness and safety, modify the color, and change the optical characteristics of a fluorescent tube. Also incandescent lamps with long-tubular geometries are similarly enclosable. Heat shrinkable plastics comprising oriented polyvinyl chloride or a polyolefin, such as polyethylene or polypropylene are used.

A thermally formed lens for lamp bulbs, described in U.S. Pat. No. 2,830,002, primarily involves the use of polymethyl methacrylate. The lens is applied to the bulb, previously covered by a suitable adhesive such as monomeric methyl methacrylate, by heating the resin, forming the combination, and cooling to provide a permanent lens covered bulb.

A catalytic fume control device, disclosed in U.S. Pat. No. 3,930,796, comprises the use of selective coverings of active oxidation catalyst such that the fumes and other odors in the confines of a room are drawn over the catalytic surface and converted to less objectionable products.

Unstressed slip-over colored boots of silicone rubber for dash lights exist.

BACKGROUND

In large signs, used as scoreboards and television picture reproduction display media, color production depends upon programmable control of, for example, three primary-colored light sources within each color module or pixel of the display. The effective contribution of each of the three light sources of each pixel is determined either by controlling the intensity of light emitted or by controlling the periodic "ON" time of each light source within the pixel. Each pixel thus provides a mix of colored light by which a wide spectrum of color for each module of the sign is produced. In small signs, light-emitting diodes (LEDs) are available in actual or near prime colors. In larger signs, requiring greater light emission than is available from LEDs, display construction depends upon larger light sources such as filament based lights. In this latter case, the generation of basic primary colors usually has depended upon coating the enclosure of the light source or adding an exterior color producing filter.

It is expensive, and often prohibitively so, to acquire and maintain inventory for maintenance of lamps for a large display which are variously permanently colored using colored glass or the like for the lamp enclosures. Use of currently known and available lamp enclosure coatings has also proved unsatisfactory due to inability to withstand weathering and heat from the lamps. Such coatings not only are unsatisfactory due to reduction of the lamp's useful life, but also add to the inventory cost as such coatings cannot be added or changed at remote sign sites. Until now, no low cost, long lasting, integumental color filter cover for a large variety of large display lamp colorations has been proposed.

BRIEF SUMMARY AND OBJECTS OF THE INVENTION

In brief summary, this novel invention overcomes or substantially alleviates known past problems related to providing integumental color filter covers, and related methods, for lamps used indoors and outdoors, such as in large displays, and comprises self-adhering, light permeable, color adding filter covers for stressed manual placement upon a wide variety of light source enclosures. Injection molding of light permeable pigmented silicone rubber satisfactorily produces filter covers according to the present invention. Thus, the present invention accommodates production of low cost, manually replaceable stressed covers which are ideal for indoor, outdoor and field use. Pigments which add colorants to fix the exact color of each filter may be dynamically injected in a mix with other mold materials as part of a single step injection molding process.

The covers according to the present invention are highly stretchable or elastic and separately formed independent of the light source. The covers may be stored for an indeterminate time in an unstressed state. Later, when manually stretched, translated and released contiguously upon a light enclosure, for example, an essentially skin-tight compressively stressed, self-biasing covering results. The attachment is tight and comprises an essentially contiguous, air-free, filter-to-light stressed enclosure. Both the elasticity and color-fast characteristics of the covers, when prestressed upon light sources, are long-lasting and essentially do not deteriorate and fade, respectively, due to weathering, sun or lamp radiation, ozone, and/or high or low temperature conditions. The covers do not materially harden, crack, peel, crumble, dry out, nor become brittle with age.

Light permeable, integumental filter covers according to the present invention comprise pigments which provide desired colors, such as authentic red, green and blue, for use in dynamic and programmably color variable displays wherein differently colored filters are placed over lamp enclosures grouped in close proximity to each other thereby producing a single pixel, the apparent color of which can be electronically varied by varying the illumination of each filter encapsulating light source. The preferred pigments do not materially leach or inhibit cure of the basic elastomeric material or cause other deleterious effects. The pixels are typically arranged in large arrays and dynamically controlled to produce periodically changing and variously colored pictures.

With the foregoing in mind, it is a major object of the invention to provide a novel expandable stressed cover for a light source which overcomes or significantly alleviates prior problems.

It is a further primary object to provide a novel separable, light permeable, integumental, stressed filter cover for manual placement over the lens of a light source enclosure.

It is a further significant object to provide a novel filter for covering a light source in stressed relation which comprises silicone rubber.

It is a still further important object to provide an improved injection moldable integumental filter cover for stressed application to a light source enclosure.

It is a principal object to provide a tight fitting and self-adhering separately formed integumental filter cover, which is selectively, manually placed in a stressed condition over a desired light enclosure.

It is a further main object to provide an integumental light source filter cover, which is long lasting and not materially affected by weather, extreme temperature and sun radiation.

It is a chief object to provide a filter cover which, when placed upon a light source, has a long useful life and does not harden, crack, peel, crumble, dry out, nor become brittle with age.

It is a main object to provide novel light permeable, variously pigmented filter covers.

It is a dominant object to provide integumental light source filter covers which are available in various colors, such as the three primary colors, whereby, grouping of said covered light sources in a close array forms a color pixel, and by independently varying emitted and time-integrated intensity of each light source accommodates generation of a wide spectrum of colors when viewed at a distance where each pixel appears as a single color.

It is a further dominant object that pixels of the type mentioned above be used to form a variable color display.

These and other objects and features of the present invention will be apparent from the detailed description taken with reference to accompanying drawings.

DETAILED DESCRIPTION OF THE ILLUSTRATED EMBODIMENTS

In this description, the term "proximal," when and if used, indicates an item normally closest to an operator. The term "distal," when and if used, refers to an item normally farthest away from the operator.

Figure 1:
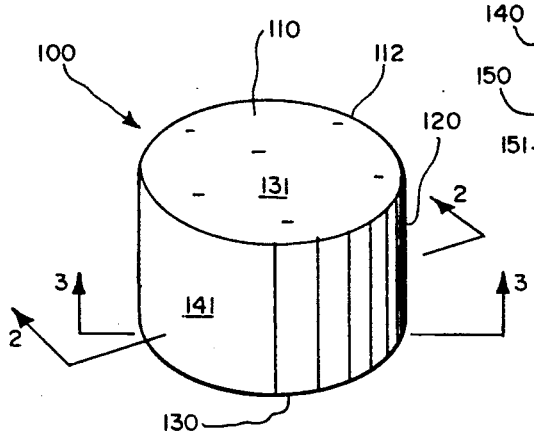
FIG. 1 is a perspective of an integumental, separately formed, stretchable filter cover, according to the present invention, in an unstressed condition before manual placement over an enclosure of a light source.
Figure 2:
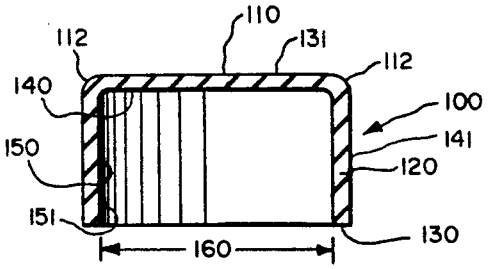
FIG. 2 is a cross sectional view of the cover of FIG. 1 taken along lines 2—2.
Figure 3:
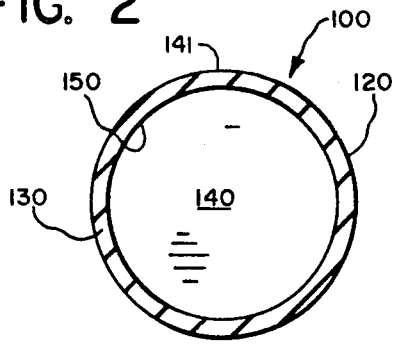
FIG. 3 is a bottom plan view of the cover of FIG. 1 taken along lines 3—3.

Reference is now made to the embodiment illustrated in FIGS. 1–6, wherein like numerals are used to designate like parts throughout. A one-piece, separately formed cover 100 for a light source enclosure, according to the present invention, is best seen in an unstressed state in FIG. 1. Cover 100 is preferably injection-molded from a composition comprising silicone rubber. In the illustrated embodiment, cover 100 is generally cylindrical, being shaped like an inverted cup. Cover 100 is closed at one end by a generally flat wall 110. Wall 110 integrally circumferentially joins a hollow sleeve or collar 120 at a rounded annular corner 112. Corner 112 is preferable of a relatively large radius so that undue wall thinning at the corner 112 does not occur when stretched over the lens of a light source. Collar 120 extends from wall 110 to an annular blunt edge 130. As seen in FIGS. 2 and 3, wall 110 of cover 100 is illustrated as being of uniform thickness throughout and comprises an outside wall surface 131 and an inside wall surface 140. Similarly, collar 120 is illustrated as being of substantially the same uniform thickness throughout and comprises outside wall surface 141 and inside wall surface 150. Further, inside wall surface 150 defines an opening at 151 adjacent edge 130 of an unstressed diameter 160. See FIG. 2.

Figure 4:
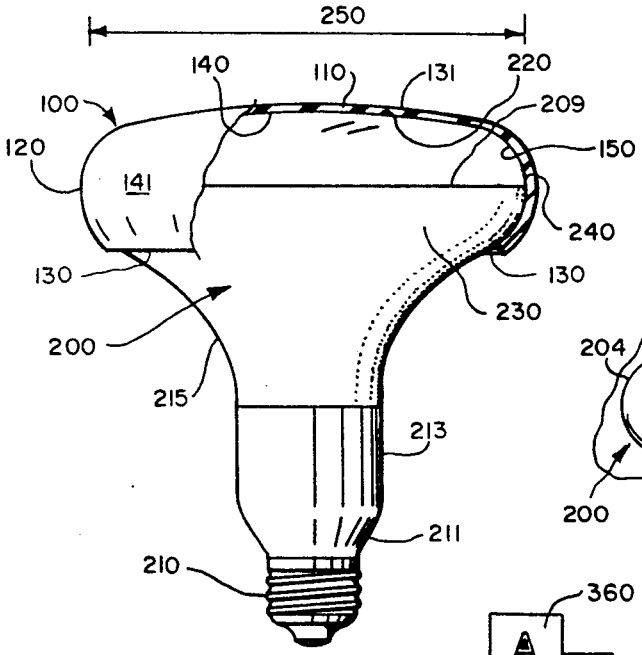
FIG. 4 is a side elevation of the cover of FIG. 1 affixed to a lamp enclosure in a stretched, stressed and memory-retaining condition with a part of the stretched cover broken away for clarity.

Filter cover 100, as illustrated in FIG. 4, is contiguously and compressively stressed and self-biased over a lens portion 220 of an exemplary light source enclosure 200. While cover 100 may be made in many forms within the scope of this invention, surface 150 comprises sufficient length to allow cover 100 to provide a stretchable, self-adhering, light permeable, integumental filter cover by which a secure though manually releasible stressed union is formed with the front lens 220 and the maximum diameter enclosure wall portion 240 of the light source enclosure 200. Light transmitted from the lens 220 of the encapsulated light source must pass primarily through the wall 110 of the cover 100 before being viewed by an observer.

The form of exemplary light source enclosure 200 is illustrated as being similar to a flared 30R20 reflector lamp. See FIG. 4. Enclosure 200 may comprise a glass envelope with a light filament therein. While many other light enclosure configurations are available and are usable within the scope of the present invention, the particular form illustrated in FIG. 4 is one which is often used in color display systems and has, therefore been selected as being exemplary.

Light source enclosure 200 is equipped with a standard metal light bulb threaded electrical socket connector 210 at the proximal end thereof. Connector 210 conventionally electrically connects to a light filament within the enclosure 200. A generally circular neck 230 of the enclosure 200 extends from the connector 210. Neck 230 is internally coated to provide a reflective surface which ends at line 209. The neck 230 comprises a divergently tapered proximal end wall portion 211 which integrally merges with a cylindrical wall portion 213 of the enclosure 200. Portion 213 integrally merges with a sharply divergently curvilinearly tapered concave wall portion 215 of enclosure 200. Wall portion 215 integrally merges with convex wall portion 240 of enclosure 200. The maximum girth or diameter 250 (FIG. 4) of enclosure 200 is measured across the maximum lateral dimension of convex wall segment 240. Wall segment 240 integrally merges with the lens or light transmitting face wall portion 220 of the enclosure 200.

The ratio of the inside unstressed diameter 160 of the cover 100 to maximum outside girth 250 of enclosure 200 is currently preferred to be on the order of 1:1 ½. Therefore, cover 100 is of a material which accommodate substantially manually stretched for placement over the enclosure 200. Other ratios and degrees of stretching are within the scope of this invention. Cover 100 is seen, in FIG. 4, to be superimposed over wall segments 220 and 240 of the enclosure 200 in contiguous, essentially "skin tight," self-biasing, stressed relation. Compressive force, imposed by the resilient memory of cover 100, causes surface 150 to compressively and contractively self-adhere against convex wall portion 240 such that the assembled diameter of edge 130 is materially less than maximum girth 250 and cover 100 is, therefore, firmly through manually removably affixed to enclosure 200 in a compressively stressed condition.

Figure 5:
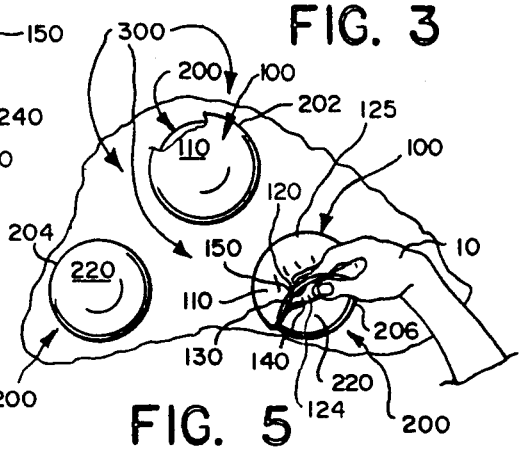
FIG. 5 is a top plan view of an array of three lamps, one lamp enclosure being without a cover, a second lamp enclosure being equipped with a cover and a third lamp enclosure receiving a cover.
Figure 5A:
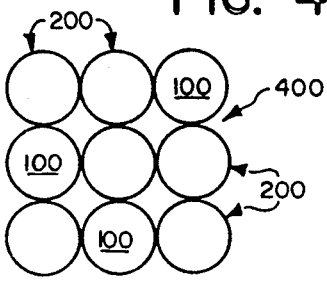

A light enclosure pattern or array 300 is illustrated in FIG. 5 as comprising three light sources each comprising an enclosure 200, which collectively comprise a single color pixel used in a large display. One enclosure 200, at 202, is shown in FIG. 5 entirely covered by a cover 100. A second enclosure 200, at 204, is shown entirely uncovered. A third enclosure 200, at 206, is shown in the process of being covered by a cover 100. Each cover 100, prior to use, is manually stretched and translated by one or more human hands 10 so as to be aligned over an associated enclosure 200, much as a hair net is placed on a human head. The cover 100 is then manually released. A portion 124 of sleeve 120 may be grasped and the opposite portion 125 of sleeve 120 snugly hooked over and contiguously against part of wall portion 240 of the enclosure 200. Cover portion 124 may then be manually stretched essentially transverse of the longitudinal axis of enclosure 200 until the cover 100 is sufficiently diametrically larger than enclosure 200 for placement to occur. Stretched cover portion 124 is then moved into transverse alignment with enclosure wall portion 240. Grasped cover portion 124 is then released and the resilient memory of the cover 100 self-retracts the boot into compressively stressed, self-biased, contiguous and secure relation with the enclosure 200, sufficient to prevent inadvertent separation.

A color pixel, such as array 300, comprises at least two differently colored light sources, at least one and preferably more than one of which is controllably changeable to vary the apparent composite color of the pixel when viewed from a distance as an apparent single source of illumination. The present invention also relates to single color on/off sources of light.

In large multicolor signs or displays, which comprise the capacity to collectively produce pictures and which are typically electrically and programmably changed, the light emitted from any source of the display is varied by controlling "ON" time of the source or the amount of power which drives the source. Each cover 100, when affixed in superimposed relation over the lens of a light source enclosure 200, as explained above, provides a stressed, light permeable, integumental, light source filter. As a consequence, a colored light source is created by the present invention, which can be used in large signs or displays. As an example, the combination of FIG. 5 may comprise a pixel, which comprises three encapsulated light sources covered, respectively, with red, green and blue covers. This configuration, properly controlled, allows generation of essentially any desired color from the color spectrum.

Large light displays installed, for example, in stadiums, along city streets and the like, are typically open to the effects of weather. Such weather comprises rain, snow, ice, sleet, radiation from the sun, normal atmospheric temperature variations and ozone. The light source itself generates radiation and high temperatures communicated directly to the cover. Integumental filter covers of the present invention preferably comprise silicone rubber and are able to withstand, without substantial deterioration, the aforementioned weathering and adverse light source effects. The end result is a filter cover which has a long useful life typically in excess of the average life time of the associated light source and is readily stretched for stressed installation. Furthermore, the self-biasing self-adhering characteristics of the silicone rubber cover provide for reliable memory retention on a light source enclosure. Surprisingly, it has been found that silicone rubber compositions can be reliably permanently pigmented and injection molded into light filter covers according to the present invention.

Silicone rubbers are chemical compounds consisting of a combination of various organic materials and silicon. Silicone rubber is available in a paste form, found to be amenable to high-speed, fully automated injection molding. As an example, a translucent liquid silicone rubber, SILASTIC 595, is available from Dow Corning and may be used to form covers 100. This silicone elastomer is supplied in A and B components which cure by a platinum-catalyzed addition reaction that takes place when the A component comprising a catalyst and the B component comprising a crosslinker are mixed and are subjected to heat.

Figure 6:
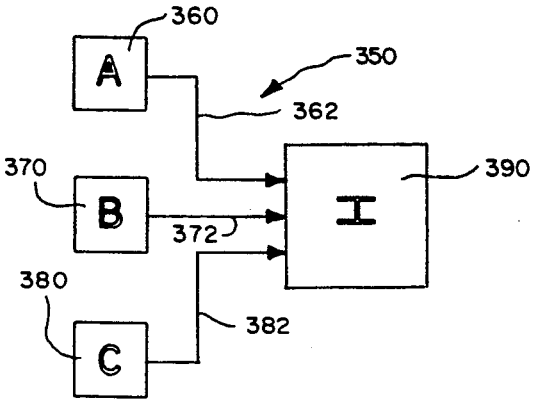
FIG. 6 is a block diagram schematically illustrating metering pump connections to a reciprocating screw pump of an injection molding machine.

An automatic mixing system 350 is generally used to mix and pump equal amounts of the A and B components into an injection molding machine. A block diagram of a mixing system which may be used to make covers 100 is shown in FIG. 6. "A" Block 360 represents a pump by which the A component is delivered to an injection molding machine via line 362. "B" block 370 represents a pump for delivering the B component to the injection molding machine 390 via line 372. A third metering pump represented by "C" block 380 is used to synchronize the mixing and delivery of colorant (pigment) to the injection molding machine "I" via line 382. Block 390 represents a reciprocating screw pump of the injection molding machine. The reciprocating screw pump provides the appropriate action and pressure to mix the pigment C with the silicone A and B components. The influx barrel of the injection molded machine is conventionally cooled with a water jacket in order to remove heat caused by the high pressures from the reciprocating screw pump. The mixed material is then injected into a heated mold cavity where the silicone catalyzes into a solid in the form of cover 100.

Inorganic pigments have been found to be light obstructive and do not produce a satisfactory light permeable silicone rubber cover. Surprisingly, organic pigments have been found to be compatible with silicone rubber and provide covers of acceptable quality, long durability and satisfactory light permeability.

A green colorant suitable for pigmenting integumental filter cover 100 is Rite Systems LQC-G238-2 preferably mixed with the A and B components on the order of a 2.75 percent ratio by weight.

Red colorants suitable for pigmenting integumental filter cover 100 are Rite Systems colorants LQC-R345-2 and LQC-R345-3 preferably mixed with A and B components at 0.61 percent and 3.65 percent by weight, respectively.

Blue colorant suitable for pigmenting integumental cover 100 are Rite Systems colorants LQC-B308-7 and LQM-B017-1 preferably mixed with A and B components at a 1.12 percent and 0.156 percent by weight, respextively.

The invention may be embodied in other specific forms without departing from the spirit or essential characteristics thereof. The present embodiment is, therefore, to be considered in all respects as illustrative and restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. Separable integumental color imparting filter cover for diametrally enlarged placement upon and self-biased stressed retention against a light source enclosure, the integumental color imparting filter cover comprising:

wall means comprising silicone rubber having memory and defining a hollow interior comprising an unstressed first diametral size, the wall means and the memory thereof accommodating (1) substantial manual diametral streched enlargement of the hollow interior so as to be larger than and to substantially surround at least a portion of the diametral size of the light source enclosure and (2) only partial reduction in the stretched diametral size of the hollow interior upon manual release so that the wall means are compressively self-biased due to the said memory contiguously against at least a portion of the light source enclosure to releasibly through forcibly affix said integumental color imparting filter cover upon the light source enclosure;

the wall means comprising selective light permeable means which pass the rays of a predetermined color of light therethrough;

the selective light permeable means comprising organic pigment colorant means.

2. An integumental color imparting filter cover according to claim 1 wherein the organic pigment colorant means comprise red organic pigment means which comprise a proportionate mixture of A and B components.

3. An integumental color imparting filter cover according to claim 2 wherein said red organic pigment means comprise a mixture of at least two organic pigments whereby the rays of light emitted from the integumental color imparting filter cover consist essentially of a red primary color.

4. An integumental color imparting filter cover according to claim 3 wherein said at least two organic pigments comprise a first pigment mixed with the silicone rubber of the wall means in an amount less than 1 percent by weight and a second pigment mixed with silicone rubber of the wall means in an amount less than 5 percent by weight.

5. An integumental color imparting filter cover according to claim 1 wherein the organic pigment colorant means comprise green organic pigment means whereby the integumental color imparting filter color selectively issues rays of light consisting essentially of an essentially green color.

6. An integumental color imparting filter cover according to claim 5 wherein the green organic pigment means is mixed with the silicone rubber of the wall means in an amount less than 5 percent by weight.

7. An integumental color imparting filter cover according to claim 1 wherein the organic pigment colorant means comprise blue organic pigment means.

8. An integumental color imparting filter covering according to claim 7 wherein said blue organic pigment means comprise a mixture of at least two organic pigments whereby the integumental color imparting filter cover selectively issues rays of light consisting essentially of an essentially blue primary color.

9. An integumental color imparting filter cover according to claim 8 wherein said at least two organic pigments comprise a first pigment mixed with the silicone rubber of the wall means in an amount less than 2 percent by weight and a second pigment mixed with the silicone rubber of the wall means in an amount less than 1 percent by weight.

10. An integumental color imparting filter cover according to claim 1 wherein the hollow interior is closed at one end and open at another end.

11. A separate, long lasting, environmental acceptable manually placeable and replaceable, light permeable, substantially stretchable silicone rubber jacket with memory for stretched placement over and reduced stretched self-biased retention upon a light source enclosure, said silicone rubber jacket comprising:

relatively thin wall means defining a hollow interior closed at one end and open at a second end, the wall means defining an unstressed first diametral size but manually stretchable to a diametral size greater than that of the light source enclosure for memory retention of the silicon rubber jacket in a partially stretched, stressed condition upon at least a portion of the light source enclosure;

the wall means comprising light permeable means which pass only the rays of a predetermined color of light therethrough;

the light permeable means comprising organic pigment colorant means.

12. A silicone rubber jacket according to claim 11 wherein the wall means comprises at least one molded wall.

13. A silicone rubber jacket according to claim 11 wherein the wall means comprise an injection-molded wall.

14. A silicone rubber jacket according to claim 11 wherein the organic pigment colorant means comprise red organic pigment means.

15. A silicone rubber jacket according to claim 14 wherein said red organic pigment means comprise a mixture of at least two pigments whereby the long lasting, environmental acceptable silicone rubber jacket selectively passes rays which essentially consist of a red primary color.

16. A silicone rubber jacket according to claim 11 wherein the organic pigment colorant means comprise green organic pigment means whereby the long lasting environmental acceptable silicone rubber jacket selectively passes rays which essentially consist of a green primary color.

17. A silicone rubber jacket according to claim 11 wherein the organic pigment means comprise blue organic pigment means.

18. A silicone rubber jacket according to claim 17 wherein the blue organic pigment means comprise a mixture of two pigments whereby the long lasting, environmental acceptable silicone rubber jacket selectively passes rays which essentially consist of a blue primary color.

19. A silicone rubber jacket according to claim 18 wherein the two pigment mixture comprises colorants comprising a first colorant mixed with silicone rubber of the wall means in an amount less than 2 percent by weight and with a second colorant mixed with the silicone rubber of the wall means in an amount less than 1 percent by weight.

20. A color illumination unit comprising:

light-emitting means which comprises a light permeable enclosing means and at least one light source which emits light;

an integumental filter cover for placement over and self-biased manually removable retention due to the forces of memory against the light permeable enclosing means, the integumental filter cover comprising relatively thin silicone rubber wall means of synthetic stretchable elastomeric material having memory, the wall means defining a hollow interior closed at one end, open at a second end and defining, when separate from the light permeable enclosing means, a first un-stressed diametral size substantially less than a diametral size of the light permeable enclosing means, the diametral size greater than said diametral size of the light permeable enclosing means for placement of the integumental filter cover over at least a portion of the light permeable enclosing means in compressive self-retaining released relation;

the silicone rubber wall means comprising light permeable means which pass only the rays of a predetermined color of light therethrough;

the light permeable means comprising organic pigment colorant means.

21. A color illumination unit according to claim 20 wherein said silicone rubber wall means comprise molded surfaces.

22. A color illumination unit according to claim 20 wherein said silicone rubber wall means comprise injection-molded surfaces.

23. A color illumination unit according to claim 20 wherein the organic pigment colorant means comprise red organic pigment means.

24. A color illumination unit according to claim 23 wherein said red organic pigment means comprise a mixture of at least two pigments whereby the silicone rubber wall means selectively pass rays which essentially consist of a red primay color.

25. A color illumination unit according to claim 20 wherein the organic pigment colorant means comprise green organic pigment means whereby the silicone rubber wall means selectively pass rays which essentially consist of a green primary color.

26. A color illumination unit according to claim 20 wherein the organic pigment colorant means comprise blue organic pigment means.

27. A color illumination unit according to claim 26 wherein the blue organic pigment means comprise two pigments whereby the silicone rubber wall means selectively pass rays which essentially consist of a blue primary color.

28. A color illumination unit according to claim 27 wherein the two pigments comprise colorants comprising a first colorant mixed with silicone rubber of the wall means in an amount less than 2 percent by weight and a second colorant mixed with the silicone rubber of the wall means in an amount less than 1 percent by weight.

29. In combination:

Lamp means comprising light source means surrounded by enclosure means;

light filter cover means contiguously superimposed in diametrally stretched condition over a lens portion of the light source enclosure means, the light filter means comprising wall means comprising silicone rubber and selectively light permeable means which substantially pass only the rays of a perdetermined color of light efficiently;

the selectively light permeable means comprising at least one organic pigment.

30. An electronic multi-color sign comprising a light display array comprising a plurality of color illumination discrete elements, each element emitting a preselected color and various elements emitting different colors, said light display array comprising:

a plurality of light-emitting means, each light-emitting means comprising at least one light source which selectively emits light and transmitting enclosing means encasing the at least on light source;

a first separable integumental filter means held by compressive self-bias contiguously through removably over at least a portion of the light transmitting encolsing means of at least one light source, the first integumental means comprising wall means of synthetic stretchable silicone rubbetr material with memory and organic pigment light permeable means within the wall means which emit only rays of a predetermined first color of light therethrough;

at least one other separable integumental filter means held by compressive self-bias contiguously through removably over at least a portion of the light transmitting means of at least another light source, the at least one other filter means comprising wall means of synthetic stretchable silicone rubber material with memory and organic pigment light permeable means within the wall means which emit only rays of a predetermined at least one other color of light therethrough.

31. A light display array according to claim 30 wherein each of said light-emitting means comprise means for replaceably connecting the light-emitting means into said electronic multicolor sign.

32. A light display according to claim 30 wherein each wall means comprises molded surfaces.

33. An array according to claim 30 wherein each wall means comprises injection-molded surfaces.

34. An array according to claim 30 wherein the organic pigment light permeable means comprise red organic pigment means whereby the integumental filter means selectively emit rays of light consisting substantially of a red primary color.

35. An array according to claim 30 wherein the organic pigment light permeable means comprises green organic pigment means whereby the integumental filter means selectively emit rays of light consisting substantially of a green primary color.

36. A light display array according to claim 30 wherein the organic pigment light premeable means comprise blue organic pigment means whereby the integumental filter means selectively emit rays of light consisting substantially of a blue primary color.

37. An array according to claim 36 wherein the blue organic pigment means comprise two pigments whereby the integumental filter means selectively emit rays of light consisting substantially of a blue primary color.

38. A light display array according to claim 37 wherein the two pigments comprise colorants comprising a first colorant mixed with silicone rubber of the wall means in an amount less than 2 percent by weight and with a second colorant mixed with the silicone rubber of the wall means in an amount less than 1 percent by weight.

39. A light display array according to claim 30 wherein the at least one other integumental filter means comprise at least a third separable integumental filter means, the at least a third integumental filter means comprising wall means of synthetic stretchable elastomeric material with memory and light permeable means within the wall means which substantially issue only rays of a predetermined third color of light therethrough.

40. In combination:

lamp means comprising light source means surrounded by enclosure means a front lens portion and a maximum diametral portion adjacent the lens portion;

light filter cover means contiguously compressively engaging the maximum diametral portion to self-retain due to memory of the light filter cover means upon the light source enclosure means, the light filter cover means contiguously and grappingly engaging the front lens portion, the light filter cover means comprising wall means comprising silicone rubber and selectively light permeable organic pigment means through which only the rays of a predetermined color of light pass.

41. A method of assembling a filter cover upon an enclosure of a light source, comprising the steps of:

stretching an organically pigmented cup-shaped silicone rubber filter cover from a first unstressed diametral state to a second diametrally enlarged state while displacing the organically pigmented cup-shaped silicone rubber filter cover into compressive and contiguous self-biased engagement with at least part of the light source enclosure.

* * * * *